United States Patent [19]

Silas

[11] Patent Number: 4,884,298

[45] Date of Patent: Dec. 5, 1989

[54] BABY FEEDING BIB

[76] Inventor: Cynthia L. Silas, 814 S. Dinwiddle St., Arlington, Va. 22204

[21] Appl. No.: 240,131

[22] Filed: Sep. 2, 1988

[51] Int. Cl.[4] ..... A41B 13/10

[52] U.S. Cl. ..... 2/49 R

[58] Field of Search ..... 2/48, 49 R, 49 A, 50, 2/51, 52, 114, DIG. 7

[56] References Cited

U.S. PATENT DOCUMENTS

| | | | |
|---|---|---|---|
| D. 59,555 | 11/1921 | Ladd | D2/48 |
| D. 233,634 | 11/1974 | Snider | D2/17 |
| D. 288,022 | 2/1987 | Marconi | D2/227 |
| 459,106 | 9/1891 | Fifield | 2/114 |
| 699,238 | 5/1902 | Reed | 2/49 R |
| 742,059 | 10/1903 | Peterson | 2/51 |
| 1,489,046 | 1/1924 | Thompson | 2/114 |
| 2,153,838 | 4/1939 | Jay | 2/125 |
| 2,504,534 | 4/1950 | Kephart et al. | 2/114 |
| 2,556,931 | 6/1951 | Miller | 2/114 |
| 2,701,364 | 2/1955 | Palm | 2/114 |
| 3,024,466 | 3/1962 | Agostini | 2/49 |
| 3,144,659 | 8/1964 | Matthews | 2/DIG. 7 X |
| 3,276,036 | 10/1966 | Cater | 2/114 |
| 3,353,189 | 11/1967 | Zimmon | 2/114 |
| 3,691,564 | 9/1972 | LaMarre et al. | 2/2 |
| 3,745,587 | 7/1973 | Bradley | 2/114 |
| 3,805,295 | 4/1974 | Garcia | 2/79 |
| 3,879,763 | 4/1975 | Smith | 2/59 |
| 4,006,495 | 2/1977 | Jones | 2/93 |
| 4,051,854 | 10/1977 | Aaron | 128/284 |
| 4,055,855 | 11/1977 | Ragone et al. | 2/114 |
| 4,068,315 | 1/1978 | Rainville | 2/114 |
| 4,258,440 | 3/1981 | McGowan | 2/114 |
| 4,422,186 | 12/1983 | Loney | 2/114 |
| 4,570,268 | 2/1986 | Freeman | 2/114 |
| 4,612,673 | 9/1986 | Underhill | 2/114 |
| 4,644,589 | 2/1987 | Pettis | 2/109 |
| 4,683,594 | 8/1987 | Feinberg | 2/105 |
| 4,737,995 | 4/1988 | Wiley | 2/114 |
| 4,769,855 | 9/1988 | Tsai | 2/114 |

FOREIGN PATENT DOCUMENTS

| | | |
|---|---|---|
| 486465 | 9/1952 | Canada . |
| 1408827 | 7/1965 | France . |

OTHER PUBLICATIONS

Maurice Gershman, "Self Adhering Nylon Tapes", *The Journal of the AMA,* vol. 168, No. 7, p. 930, dated Oct. 19, 1958.

"Touch and Close" Baby Clothes Thanks to Velcro, (date unknown).

Velcro Product News, Oct.-Nov. 1976, PN No. 27.

*Primary Examiner*—Werner H. Schroeder
*Assistant Examiner*—Jeanette E. Chapman
*Attorney, Agent, or Firm*—Lowe, Price, LeBlanc, Becker & Shur

[57] ABSTRACT

A baby feeding bib comprises an apron-like member made of flexible material, with sleeves openable along their length so as to be easily positioned around the baby's arms. Fastening material extending along the seams defining the opening along the sleeve length are detachably secured together so that the sleeves encircle the baby's arms. The resulting closed seam extending the sleeve length is preferably disposed out of the line of the baby's sight to prevent the baby from tampering with the closed seam.

11 Claims, 1 Drawing Sheet

BABY FEEDING BIB

TECHNICAL FIELD

The present invention relates to bibs, and more particularly, to an improved baby feeding bib having sleeves that may be secured about a baby's arm without directing the arm through one sleeve opening and out the other sleeve opening at the other end of the sleeve.

BACKGROUND ART

Bibs are commonly used on newborn babies and Young children to protect the chest area, especially clothing (e.g., shirts, pajama tops, etc.) that the baby wears while eating, from food stains. Naturally, the process of learning to eat with fingers or utensils is messy and the baby tends to soil his arms with food as well. For this reason, long sleeved bibs can be used to protect the baby's clothes sleeves while eating.

Whereas sleeveless bibs are quite easy to put on and remove by fastening a pair of straps around the baby's neck, it is difficult to dress a baby with a sleeved bib as the baby is often not capable of assisting in directing their arms through the sleeve openings and then straightening their arm at the appropriate time. Thus, it is necessary for the parent to insert the baby's arm through one sleeve opening and pull it from the other end. The second sleeve arm is usually more difficult to work with as it is necessary to bend the baby's arm further to direct it into the sleeve opening. Furthermore, as it is more natural for parents to first put the baby in the highchair and then proceed to put on the bib, it is usually much more difficult to manipulate a baby's arm into the bib sleeves once the baby is in the highchair, thereby further exasperating the problem.

DISCLOSURE OF THE INVENTION

It is according one object of the present invention to provide a sleeved bib that is easy to dress the baby in.

Another object is to provide a sleeved bib wherein, after attaching the bib to the baby's neck, the sleeve material is wrapped around the baby's arms and then fastened to form the sleeves.

Yet another object is to provide a sleeved bib wherein the sleeve material has fastening material along "seam" edges of the sleeve that engage each other to establish substantially cylindrical sleeves wrapped around the baby's arms.

Still another object is to provide a sleeved bib wherein the "closed seam" defined by the fastening materials extending along the "seam" edges is arranged to be substantially out of contact with any food or liquid on the sleeve.

Still another object is to provide a sleeved bib wherein the closed seam is located out of the baby's line of sight to avoid distracting the baby from eating.

A baby feeding bib, according to the present invention comprises an apron-like member made of flexible material having a front surface and a rear surface, and including an upper edge shaped to fit the neck of a baby to be fed. Attachment members on the upper end of the apron-like member detachably connect the bib to the baby's neck. A pair of sleeves extend laterally from the apron-like member. In accordance with the invention, at least one of the sleeves is defined by a length of sleeve material extending laterally from the apron-like member between a pair of longitudinal seam edges of the sleeve material. Each seam edge has fastening members for engaging with the fastening members on the other seam edge to establish the sleeve encircling to cover the baby's arm.

In a preferred embodiment, the seam edges, in fastening engagement with the fastening means, define a closed seam located out of the baby's line of sight. This closed seam is preferably located in the underarm area of the sleeve when worn by a baby. Alternatively, the closed seam faces rearwardly in relation to the front surface of the apron-like member covering the baby's chest so as to be out of the baby's line of sight.

The fastening members preferably extend substantially the entire length of each seam edge. A preferred fastening material is VELCRO TM tape; specifically, a continuous strip of VELCRO TM hook tape formed along one seam edge and VELCRO TM loop tape along the other seam edge. The tapes are preferably arranged on opposing front and rear surfaces of the sleeve so that, in juxtaposed fastening contact, the uppermost seam edge faces rearwardly to enable spilled foods to flow over the closed seam without entering between the seam edges and thereby soiling the fastening means or baby's clothes.

Of course, both sleeves may be provided with sleeve material having open seam edges and fastening members therealong.

A method of fitting a baby with a sleeved bib is also disclosed. The method comprises the steps of first fastening the bib to the baby's neck. Next, sleeve material projecting laterally from the apron-like bib member is wrapped around the baby's arm and the seam edges are secured together to establish the sleeve encircling the baby's arm. After use, the bib is removed in reverse sequence of steps.

Still other objects and advantages of the present invention will become readily apparent to those skilled in this art from the following detailed description, wherein only the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description are to be regarded as illustrative in nature, and not as restrictive.

BEST MODE FOR CARRYING OUT THE INVENTION

Figure 1:
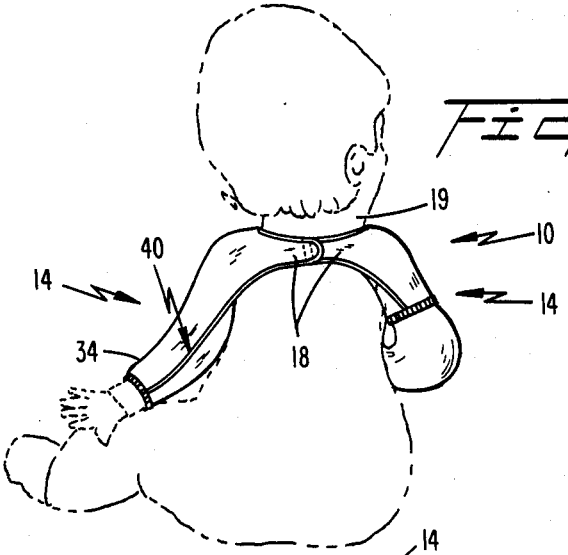
FIG. 1 is a perspective view of a baby wearing a feeding bib according to the invention.
Figure 2:
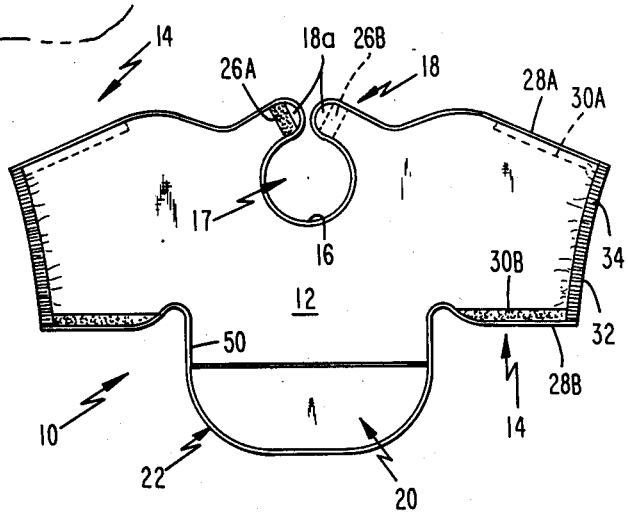
FIG. 2 is a front plan view of a sleeved baby's bib in accordance with the present invention, with the bib and sleeves open into substantially flat configuration.

Reference is now made to FIGS. 1 and 2 of the drawing wherein a preferred embodiment of a long-sleeved baby's bib 10 according to my invention comprises an apron-like member 12 formed with substantially identical sleeves 14 at side portions thereof, an upper edge 16 defining an opening 17 and integral attachment straps 18 shaped to fit and be secured around the neck 19 of a baby to be fed. An optional, preferred pocket 20 may be provided at a lower portion 22 of the apron-like member 12.

The straps 18 are sized to fit around the baby's neck 19. Straps 18 have free ends 18A formed with attachment means 24, such as hook and loop VELCRO TM tape portions 26A and 26B, respectively, engageable with each other to secure the bib 10 around the baby's neck. As will occur to persons skilled in the art of designing baby wear, tape portions 26A,26B may be snap-fasteners, or other suitable attachments of a detachable type.

In accordance with the invention, each long sleeve 14 is openable along substantially its entire length, and thereby formed with upper and lower seam edges 28A and 28B, with the edges including fastening means 30A,30B engageable with each other such that, in fastening engagement, each sleeve encircles and extends along a baby's arm to protect the baby's clothes sleeves (e.g., baby's shirt or pajama top) from being soiled with food. The side edge 32 extending between upper and lower edges 28A,28B of each sleeve 14 preferably includes a flexible elastic band seam therein to define an elastic cuff 34 at the end of each sleeve. Fastening means 30A,30B in the preferred embodiment, are preferably hook and loop tape (e.g., VELCRO TM tape), respectively extending the entire length of each edge 28A,28B and thereby along substantially the entire length of each sleeve.

It is an important feature of the present invention to locate seam edges 28A,28B such that the closed or juxtaposed seam 40 (i.e., fastening means 30A,30B attached together to secure each sleeve 14 about the baby's arm) is located out of the baby's line of sight, even when the baby turns its head from side to side as part of normal head movement. Otherwise, if the baby sees the "seam", the baby will tend to want to play with it (i.e., the VELCRO TM fastening tapes or other suitable fasteners); the baby will therefore become easily distracted and not eat its food and perhaps remove the bib, upsetting the food in the process. For this reason, it is preferred to locate the closed seam 40 along the underarm area of the sleeve 14, although the closed seam can also be located in rearwardly facing portions of the sleeve out of the baby's normal line of sight. By way of example, and with bib 10 and sleeves 14 secured to the baby, the closed seam 40 is preferably located rearwardly of an imaginary plane passing vertically through the mid-section of the baby's shoulders. Alternatively, the closed seam can be in the underarm area or anywhere inbetween the underarm area and the top of the sleeve in a rearward facing portion thereof.

Figure 4:
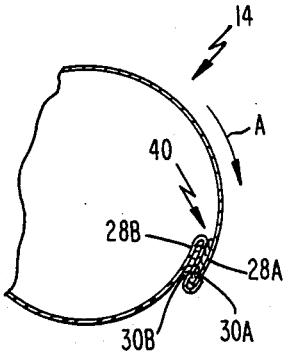
FIG. 4 is a cross-sectional view along the line 4—4 of FIG. 3 depicting a preferred characteristic of the seam edges in fastening engagement.

It is another preferred feature of the present invention to locate the lower fastening means 28B so that it is formed to extend along an outer surface of the fabric forming the sleeve 14. The term "outer surface" is an exterior surface of the sleeve while "inner surface" is an interior sleeve surface adapted to contact a baby undergarment worn beneath the sleeve. The upper fastening means 30B is formed along the inner surface. Thereby, when the fastening means 30A,30B are brought into mating fastening engagement (FIG. 4) with the upper fastening means 30A juxtaposed atop the lower fastening means 30B, the upper seam edge 28A lies atop the lower seam edge 28B to advantageously allow food or liquid spilled onto the sleeve to flow, in the direction of arrow A, over the closed seam 40 without entering inbetween and soiling the fastening means 30A,30B.

Figure 3:
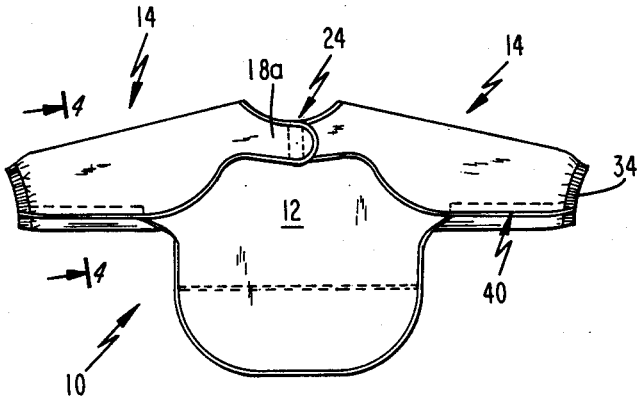
FIG. 3 is a rear view of the sleeved bib of FIGS. 1 and 2 depicting the neck straps fastened together and the seam edges of each sleeve fastened together to establish substantially cylindrical sleeves adapted to encircle to cover the baby's arms, with the resulting closed seam facing in a rearward direction out of the baby's line of sight.

Another preferred feature of the present invention is that of locating the upper and lower seam edges 28A and 28B so that the closed seam 40 is formed in the underarm or rear lower portion of the sleeve 14 as depicted in FIG. 3 so that the closed seam does not extend along the shoulders and top of the sleeve where it is subject to greater stress and possible undesirable disengagement of fasteners 30A,30B.

As depicted in FIGS. 1 and 2, fastening tapes 30A,30B are preferably single, continuous lengths of VELCRO TM tape stitched along its edges or heat-sealed to upper edges 28A,28B, respectively. However, as will immediately occur to persons skilled in the art, the continuous tapes 30A,30B may be replaced with plural pieces of VELCRO TM tape, snap fasteners, or other suitable fastening means.

The material forming bib 10 can be fabric, plastic, etc. In a preferred embodiment, water repellent nylon is used as it is lightweight, soil repellent and easy to clean.

A double seam binding 50 may be sewn or otherwise secured to the periphery of the bib 10 for use as a facing or trim material.

Although sleeves 14 are disclosed as full length sleeves, they may obviously be short sleeve length as depicted for illustration purposes on the right arm of an infant shown in FIG. 1.

In the preferred embodiment of FIGS. 1 and 2, the apron-like member 12 and sleeves 14 forming the bib 10 are preferably cut from the same material although it is within the scope of the invention to form the apron and sleeves from different materials. The bib 10 of FIG. 2 is essentially depicted as a pattern wherein the material forming bib 10 lies substantially flat when not in use. This material is therefore easy to cut out and sew.

The above description of the preferred embodiment of the invention must be considered as illustrative only of the principal of the invention and not limitative. Indeed, it may be easily understood that numerous modifications could be made by those skilled in the art without departing from the spirit of the invention as defined in the claims below.

What is claimed is:

1. A baby feeding bib, comprising:

(a) an apron-like member made of flexible material having a front surface and a rear surface, and including an upper edge shaped to fit the neck of a baby to be fed;

(b) attachment means on an upper end of said apron-like member for detachably connecting said member to the neck of the baby; and (c) a pair of sleeves extending laterally from the apron-like member, at least one of said sleeves being defined by a length of material extending laterally from the apron-like member between a pair of longitudinal seam edges, each seam edge having fastening means for engaging with the fastening means on the other seam edge to establish said sleeve encircling to cover the baby's arm, wherein said seam edges, in fastening engagement of said fastening means, define a closed seam located out of the baby's line of sight, wherein said closed seam faces rearwardly in relation to a front surface of the apron-like member covering the baby's chest, said closed seam thereby being located on the sleeve rearwardly of an imaginary plane passing vertically through the mid-section of the baby's shoulders and further including said fastening means being hook and loop tapes respectively arranged on opposing front and rear surfaces of the sleeve seam edges so that, in juxtaposed fastening contact, the uppermost seam edge faces downwardly to enable spilled foods to flow over the closed seam without entering between the seam edges and thereby soiling the fastening means.

2. The bib of claim 1, wherein said fastening means extends substantially the entire length of the sleeve.

3. The bib of claim 2, wherein said fastening means includes hook and loop pieces respectively extending along said seam edges.

4. The bib of claim 3, wherein each piece is a substantially continuous strip extending the entire sleeve length.

5. The bib of claim 1, wherein both sleeves include said seam edges and said fastening means.

6. The bib of claim 1, wherein both sleeves include said seam edges and said fastening means.

7. The bib of claim 1, wherein both sleeves include said seam edges and said fastening means.

8. The bib of claim 1, wherein said attachment means includes VELCRO TM material.

9. The bib of claim 1, wherein each sleeve has said fastening means.

10. The bib of claim 1, wherein said sleeves are short sleeves.

11. The bib of claim 1, wherein said sleeves and apron member are of unitary construction formed from a single piece of said flexible material.

* * * * *